US009237979B2

(12) United States Patent
Carnell et al.

(10) Patent No.: US 9,237,979 B2
(45) Date of Patent: Jan. 19, 2016

(54) GAS DISTRIBUTION ASSEMBLY

(75) Inventors: Todd M. Carnell, Batesville, IN (US); Brian J. Hoffman, Lawrenceburg, IN (US); David C. Newkirk, Lawrenceburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 1318 days.

(21) Appl. No.: 13/083,799

(22) Filed: Apr. 11, 2011

(65) Prior Publication Data

US 2012/0258655 A1 Oct. 11, 2012

(51) Int. Cl.

| | |
|---|---|
| ***E04H 3/08*** | (2006.01) |
| ***A61G 13/10*** | (2006.01) |
| ***A61G 12/00*** | (2006.01) |

(52) U.S. Cl.

CPC ..... *A61G 12/005* (2013.01); *E04H 3/08* (2013.01)

(58) Field of Classification Search

CPC .... A61G 12/005; A61G 2205/10; E04B 2/72; E04C 2/51; H01R 13/73; A47B 81/00; E04H 3/08; E04F 19/08

See application file for complete search history.

(56) References Cited

U.S. PATENT DOCUMENTS

| | | | | |
|---|---|---|---|---|
| 3,462,892 | A * | 8/1969 | Meyer | 52/28 |
| 4,104,710 | A * | 8/1978 | Damico et al. | 362/130 |
| 4,338,485 | A * | 7/1982 | Fullenkamp et al. | 174/501 |
| 4,523,683 | A * | 6/1985 | Fullenkamp et al. | 211/190 |
| 4,646,211 | A * | 2/1987 | Gallant et al. | 362/149 |
| 4,714,091 | A | 12/1987 | Wagner | |
| 4,807,659 | A * | 2/1989 | Schindele | 137/360 |
| 4,821,470 | A * | 4/1989 | Kappers et al. | 52/220.1 |
| 4,905,433 | A * | 3/1990 | Miller | 174/504 |
| 5,247,962 | A | 9/1993 | Walker | |
| 5,448,859 | A * | 9/1995 | Walker et al. | 52/38 |
| 5,452,807 | A * | 9/1995 | Foster et al. | 211/26 |
| 5,644,876 | A * | 7/1997 | Walker | 52/220.7 |
| 5,836,355 | A | 11/1998 | Markulec et al. | |
| 5,878,536 | A * | 3/1999 | Demmitt et al. | 52/36.4 |
| 5,890,326 | A * | 4/1999 | Gallant et al. | 52/36.1 |
| 5,953,871 | A * | 9/1999 | MacConnell et al. | 52/220.1 |
| 5,966,760 | A * | 10/1999 | Gallant et al. | 5/658 |
| 5,983,884 | A | 11/1999 | Lee | |
| 6,145,253 | A * | 11/2000 | Gallant et al. | 52/36.1 |
| D443,365 | S * | 6/2001 | Walker | D24/232 |
| 6,256,935 | B1 * | 7/2001 | Walker | 52/27 |
| 6,269,594 | B1 | 8/2001 | Walker | |
| D452,573 | S * | 12/2001 | Walker | D24/232 |
| 6,325,097 | B1 * | 12/2001 | Gallant et al. | 137/505 |
| 6,349,744 | B1 | 2/2002 | Grosshart | |

(Continued)

FOREIGN PATENT DOCUMENTS

| | | | |
|---|---|---|---|
| EP | 2543352 | A1 * | 1/2013 |
| EP | 2510913 | A3 * | 5/2013 |

OTHER PUBLICATIONS

Selected documents from the prosecution history of corresponding European Application No. 12162169.2, Apr. 2013 to Apr. 2014 time frame (10 pages).*

*Primary Examiner* — Rodney Mintz
(74) *Attorney, Agent, or Firm* — Barnes & Thornburg LLP

(57) ABSTRACT

A gas delivery system for a patient room may include a centralized gas distribution system that provides a source of gas and a manifold for distributing the gas in the patient room. The gas delivery system may include a gas outlet coupled to a wall of the patient room and line connecting the gas outlet to the manifold.

14 Claims, 7 Drawing Sheets

(56) References Cited

U.S. PATENT DOCUMENTS

| | | | | |
|---|---|---|---|---|
| 6,405,491 | B1 | 6/2002 | Gallant | |
| 6,895,715 | B2 * | 5/2005 | Gallant et al. | 52/29 |
| 7,040,057 | B2 * | 5/2006 | Gallant et al. | 52/36.1 |
| 7,174,678 | B2 | 2/2007 | Gallant | |
| 7,204,714 | B2 * | 4/2007 | Walker et al. | 439/532 |
| 7,213,618 | B2 | 5/2007 | Milburn et al. | |
| 7,537,030 | B2 | 5/2009 | Gallant | |
| 7,600,536 | B1 * | 10/2009 | Steininger | 137/887 |
| 7,735,266 | B2 * | 6/2010 | Gallant et al. | 52/36.4 |
| 8,006,440 | B2 * | 8/2011 | Thomas et al. | 52/29 |
| 8,215,065 | B2 * | 7/2012 | Gallant | 52/36.1 |
| 8,240,092 | B2 * | 8/2012 | Gallant et al. | 52/29 |
| 8,375,646 | B2 * | 2/2013 | Newkirk et al. | 52/29 |
| 8,458,962 | B2 * | 6/2013 | Gallant et al. | 52/36.1 |
| 8,522,488 | B1 * | 9/2013 | Newkirk et al. | 52/36.1 |
| 8,640,391 | B2 * | 2/2014 | Newkirk et al. | 52/36.1 |
| 8,707,633 | B2 * | 4/2014 | Han et al. | 52/79.5 |
| 9,010,031 | B1 * | 4/2015 | Webb et al. | 52/36.1 |
| 2002/0108177 | A1 * | 8/2002 | Hensley et al. | 5/600 |
| 2003/0009952 | A1 * | 1/2003 | Gallant et al. | 52/36.4 |
| 2003/0014817 | A1 * | 1/2003 | Gallant et al. | 5/600 |
| 2003/0019165 | A1 * | 1/2003 | Gallant et al. | 52/36.4 |
| 2003/0177713 | A1 | 9/2003 | Walker et al. | |
| 2004/0231248 | A1 * | 11/2004 | Walker et al. | 52/27 |
| 2004/0237202 | A1 * | 12/2004 | Gallant et al. | 5/658 |
| 2005/0102912 | A1 * | 5/2005 | Gallant et al. | 52/36.4 |
| 2005/0275548 | A1 * | 12/2005 | Abel et al. | 340/614 |
| 2007/0068089 | A1 * | 3/2007 | Gallant et al. | 52/27 |
| 2008/0104901 | A1 * | 5/2008 | Olvera | 52/173.1 |
| 2008/0236054 | A1 * | 10/2008 | Gallant et al. | 52/36.1 |
| 2008/0276998 | A1 * | 11/2008 | Boyher et al. | 137/561 A |
| 2010/0095604 | A1 | 4/2010 | Newkirk et al. | |
| 2010/0205739 | A1 * | 8/2010 | Gallant et al. | 5/600 |
| 2010/0223857 | A1 * | 9/2010 | Sutton et al. | 52/27 |
| 2010/0243928 | A1 | 9/2010 | Flick et al. | |
| 2010/0263308 | A1 * | 10/2010 | Olvera | 52/220.2 |
| 2010/0323559 | A1 * | 12/2010 | Chambers | 439/638 |
| 2011/0072588 | A1 * | 3/2011 | Gallant et al. | 5/658 |
| 2011/0209835 | A1 * | 9/2011 | Balbona et al. | 160/127 |
| 2011/0283632 | A1 * | 11/2011 | Sutton et al. | 52/36.1 |
| 2013/0074343 | A1 * | 3/2013 | Newkirk et al. | 29/897.32 |
| 2014/0110361 | A1 * | 4/2014 | Newkirk et al. | 211/13.1 |
| 2014/0311066 | A1 * | 10/2014 | Quinlivan | 52/220.1 |
| 2015/0075085 | A1 * | 3/2015 | Newkirk et al. | 52/27 |

* cited by examiner

GAS DISTRIBUTION ASSEMBLY

BACKGROUND

The present disclosure is related to systems and methods for delivering medical gases in a hospital room. More specifically, the present disclosure is related to a medical gas delivery system for delivering various medical gases to a hospital room.

Clinical care settings, such as a hospital room, for example, serve a two-fold purpose of delivering healthcare services. In the first instance, the hospital room serves as an area for delivery of medical care. In the second instance, the hospital room serves as a residence for a recuperating patient.

With regard to the delivery of healthcare services, the hospital room must include state of the art technology accessible to the healthcare provider during the delivery of care. As the acuity of a patient's illness or injury increases, the complexity of additional equipment required to assist with the delivery of care increases. For example, medical gases such as compressed air, oxygen, and vacuum may be delivered to the patient room. Pneumatic equipment may use compressed air as a source of power, oxygen may be provided to aid patients in breathing, and vacuum may be applied to help remove fluids from patients.

The delivery of medical gases, electrical power, and data communication lines tends to be routed through the headwall area of the patient room. The headwall area also tends to support lighting for the patient room and healthcare equipment thereon. As a result, the headwall area may be crowded with wiring, electrical components and equipment useful in caring for a patient. In order to provide all the features for treatment of the patient and maintenance of the features, hospitals may use headwall structures that have additional capacity for future uses. Hospitals also may provide redundant features so that flexibility in treating the patient may be achieved.

Medical gases are delivered to each patient room by a centralized gas distribution system. The centralized gas distribution system supplies compressed air, oxygen gas, and vacuum by way of three separate conduits to a centralized gas manifold included in the headwall as described in U.S. Patent Application 2010/0095604. The centralized gas manifold includes three sets of outlet ports, each set of outlet ports provides only one type of medical gas. The centralized gas manifold tends to include additional ports beyond the number of gas outlets included in the head wall so that future uses of the headwall and patient room may be supported by the centralized gas manifold. As a result, additional capacity and complexity is included in the centralized gas manifold that may not be used by the caregiver.

SUMMARY OF THE INVENTION

The present application discloses one or more of the features recited in the appended claims and/or the following features which, alone or in any combination, may comprise patentable subject matter:

According to one aspect of the disclosure, a gas delivery assembly for a patient room in a healthcare facility includes a centralized gas distribution system, a first modular gas manifold, a first flexible line, and a first gas outlet. The centralized gas distribution system may include a source of a first gas, a first supply line coupled to the source of the first gas, and a first supply port coupled to the first supply line. The modular gas manifold may include a body, a supply connector, and a plurality of output ports. The body may be formed to include a space and the supply connector may be coupled to the body and to the first supply port to admit the first gas from the source into the space. The plurality of output ports may be coupled to the body in fluid communication with the space. The first flexible line may be coupled to one of the plurality of output ports. The first gas outlet may be coupled to a wall included in the patient room and may be coupled to the flexible line to cause the first gas to be supplied to a caregiver upon demand.

In some embodiments, the wall includes a modular frame structure. The modular frame structure may include a plurality of columns secured together by removable fasteners and spaced apart from one another by a distance to form a gap therebetween. The modular frame structure may also include a plurality of panels coupled to the modular frame structure to form a surface. The panels being may be secured to the modular frame structure by removable fasteners. The removable fasteners securing the panels to the modular frame structure may be positioned in the gap and may be recessed from the surface of the panels. The gas outlet may be coupled to at least one of the panels.

In some embodiments, the first modular gas manifold and the supply line may lie in the gap behind the panels. One of the panels may be formed to include a first and a second aperture that open into the gap. The first aperture may be configured to receive the first gas outlet therein. The second aperture may be covered by a knock-out plate that is coupled to the panel.

In some embodiments, a second flexible line may be coupled to another of the plurality of the output ports included in the first modular gas manifold. A second modular gas manifold may include a body, a supply connector, and a plurality of output ports. The body may be formed to include a space. The supply connector may be coupled to the body of the second modular gas manifold and to the second flexible line. The supply connector may be configured to admit gas from the second flexible line into the space formed in the body of the second modular gas manifold. The plurality of output ports may be coupled to the body of the second modular gas manifold in fluid communication with the space formed in the body of the second modular gas manifold.

In some embodiments, the gas delivery assembly may further include a third flexible line coupled to one of the plurality of output ports included in the second modular gas manifold. The third flexible line may be coupled to a second gas outlet coupled to the wall.

In some embodiments, the gas is compressed air. The gas may be oxygen. The gas may be a vacuum. The gas may also be nitrogen.

In some embodiments, the centralized gas distribution system may further includes a source of a second gas, a second supply coupled to the source of the second gas, and a second supply port coupled to the second supply line. The gas distribution assembly may further include a second modular gas manifold that is spaced-apart from the first modular gas manifold. The second modular gas manifold may include a body formed to include a space, a supply connector coupled to the body and to the second supply line to admit the second gas from the source into the space, and a plurality of output ports coupled to the body in fluid communication with the space.

In some embodiments, the gas distribution assembly may further comprise a second gas outlet and a second flexible line. The second gas outlet may be coupled to the wall in spaced-apart relation to the first gas outlet. The second flexible line may be coupled to one of the plurality of output ports included in the second modular gas manifold and to the second gas outlet to provide the second gas to the caregiver upon demand.

In some embodiments, the gas distribution assembly further includes a third flexible line and a third modular gas manifold. The third flexible line may be coupled to another of the plurality of output ports included in the first modular gas manifold. The third modular gas manifold may include a body formed to include a space, a supply connector coupled to the body of the third modular gas manifold and to the third flexible line to admit the first gas from the third flexible line into the space formed in the body of the third modular gas manifold, and a plurality of output ports coupled to the body of the third modular gas manifold in fluid communication with the space formed in the body of the third modular gas manifold.

According to one aspect of the disclosure, a gas delivery assembly for a patient room in a healthcare facility including a wall comprises a gas delivery assembly for a patient room in a healthcare facility includes a centralized gas distribution system, a first modular gas manifold, a second modular gas manifold, and a pair of gas outlets. The centralized gas distribution system may include a source of a gas, a supply line coupled to the source, and a supply port coupled to the supply line. The first modular gas manifold may include a body formed to include a space, a supply connector interconnecting the body and the supply port to provide fluid communication with the space, and a pair of output ports coupled to the body. The second modular gas manifold may include a body formed to include a space, a supply connector interconnecting the body and one of the output ports included in the first modular gas manifold to provide fluid communication with the space of the first modular gas manifold and the space of the second modular gas manifold, and a pair of output ports coupled to the body of the second modular gas manifold. The pair of gas outlets may be coupled to the wall and may be coupled to the outlet ports of the second modular gas manifold in fluid communication with the space formed in the second modular gas manifold.

In some embodiments, the supply port of the centralized gas distribution system may be a female-socket quick-disconnect coupling. The supply connector of the first modular gas manifold may be a mating quick-disconnect plug.

In some embodiments, the gas distribution assembly may further include a wall. The wall may include a modular frame structure. The modular frame structure may include first column and second columns that extend upwardly from a floor. The first and second columns may be spaced apart from one another to define a vertical gap therebetween. The first and second modular gas manifolds may lie in the vertical gap between the first and second columns.

In some embodiments, the gas distribution assembly may further include a wall. The wall may include a modular frame structure. The modular frame structure may include first and second columns spaced-apart laterally from one another and first and second cross bars. The first cross bar may interconnect the first and second columns. The second cross bar may be spaced apart below the first cross bar. The second cross bar may interconnect the first and second columns and cooperate with the first cross bar to define a horizontal gap therebetween. The first and second modular gas manifolds may lie in the vertical gap between the first and second cross bars.

In some embodiments, the gas distribution assembly may further include a wall. The wall may include a modular frame structure and a panel coupled to the modular frame structure to form a surface. The panel may be formed to include a plurality of apertures that open into the gap. The pair of gas outlets may lie in two of the plurality of apertures. The wall may further include a knock-out panel. The knock-out panel may be coupled to the panel to cover one of the plurality of apertures not being filled with one of the pair of gas outlets.

In some embodiments, the gas distribution assembly may further include a pair of flexible lines. The flexible lines may interconnect the pair of gas outlets and the pair of outlet ports included in the second modular gas manifold.

According to one aspect of the disclosure, a gas delivery assembly for a patient room in a healthcare facility including a wall comprises a centralized gas delivery, a first modular gas manifold, a second modular gas manifold, and three gas outlets. The centralized gas distribution system may include a source of a gas, a supply line coupled to the source, and a supply port coupled to the supply line. The first modular gas manifold may include a body formed to include a space, a supply connector interconnecting the body and the supply port to provide fluid communication with the space, and a pair of output ports coupled to the body. The second modular gas manifold may include a body formed to include a space, a supply connector, and a pair of output ports coupled to the body of the second modular gas manifold. The supply connector may interconnect the body of the second modular gas manifold and the first modular gas manifold to provide fluid communication with the space of the first modular gas manifold and the space of the second modular gas manifold. The three gas outlets may be coupled to the wall and two of the three gas outlets may be coupled to the pair of output ports included in the first modular gas manifold. The remaining gas outlet may be coupled to one of the pair of output ports included in the second modular gas manifold.

In some embodiments, the first modular gas manifold may further include an expansion output port that is arranged to open into the space of the first modular gas manifold. The supply connector of the second modular gas manifold may be coupled to the expansion output port of the first modular gas manifold to cause the space in the second modular gas manifold to be in fluid communication with the space in the first modular gas manifold.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which:

FIG. 5 is an elevation view and diagrammatic view of yet another embodiment of a gas delivery assembly including three gas manifolds;

FIG. 6 is a view similar to FIG. 5 showing the gas delivery assembly of FIG. 5 after two additional gas manifolds have been added;

DETAILED DESCRIPTION OF THE DRAWINGS

Figure 1:
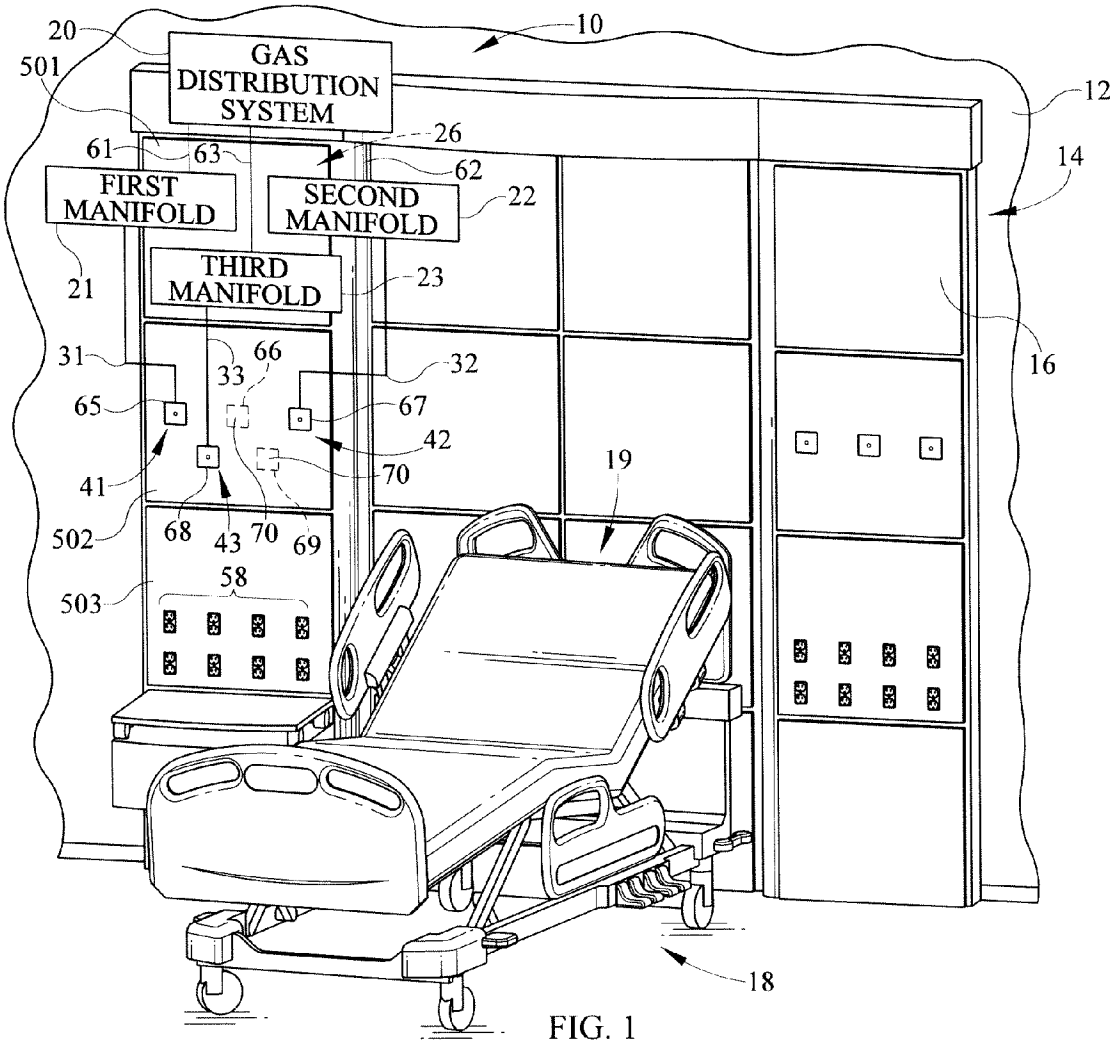
FIG. 1 is a perspective view of a head wall included in a patient's room with a hospital bed arranged in front of the head wall.
Figure 2:
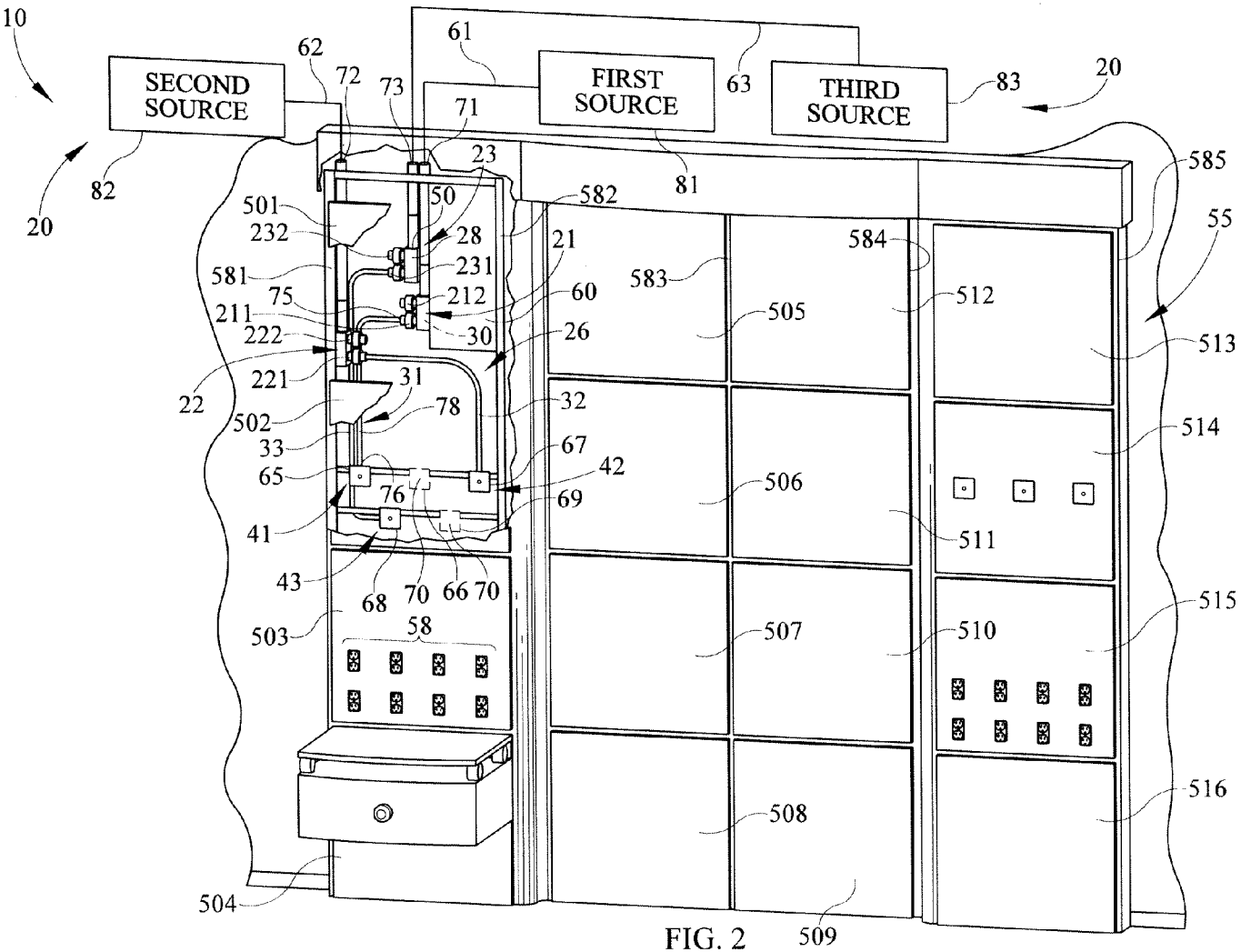
FIG. 2 is a view similar to FIG. 1 with the hospital bed removed and portions of the head wall broken away to reveal a gas delivery assembly positioned in a gap formed in the head wall.

According to the present disclosure, a gas delivery assembly 10 for use in a patient room in a healthcare facility is provided in a wall 12 of patient room as suggested in FIG. 1 and shown in FIG. 2. The head wall 14 is configured to route electricity, compressed air, oxygen, and vacuum from the wall 12 to an outer surface 16 of the head wall 14 for use by a caregiver. A hospital bed 18 is positioned with a head end 19 of the hospital bed 18 adjacent to the head wall 14 so that medical equipment and tools used to treat the patient may be connected to the electrical and gas distribution systems included in the head wall 14.

The gas delivery assembly 10 comprises a centralized gas distribution system 20, a modular gas manifold 21, a flexible line 31, and a gas outlet 41 as shown in FIG. 2. The centralized gas distribution system 20 is arranged to run throughout the healthcare facility to provide medical gases to each patient room in the hospital. The modular gas manifold 21 is positioned to lie in a vertical gap 26 formed in the head wall 14 and is coupled to the gas distribution system 20. The flexible line 31 interconnects the modular gas manifold 21 to the gas outlet 41 so that a caregiver may use the medical gas provided by the gas distribution system 20.

As shown in FIG. 2, the gas distribution system 20 includes a first source 81 of a first gas, a first supply line 61, and a first supply port 71. The first source 81 of the first gas is positioned to lie outside of the head wall 14. The first supply line 61 is coupled to the first source 81 to provide the first gas to the patient's room. The first supply line 61 terminates in the gap 26 at a first supply port 71. The first modular gas manifold 21 is coupled to the first supply port 71 so that the first gas may be distributed as desired in the head wall 14.

The first modular gas manifold 21 illustratively includes a body 28 formed to include a space 30 therein, a supply connector 50, and a plurality of output ports 211, 212 as shown in FIGS. 2-7. The supply connector 50 interconnects the body 28 and the first supply port 71 to provide fluid communication of the first gas from the first source 81 into the space 30. The plurality of output ports 211, 212 are coupled to the space 30 formed in the body 28 to provide the first gas when a flexible line is coupled to one of the output ports 211, 212.

Other flexible lines 31-39 are substantially similar to first flexible line 31, and thus, only first flexible line 31 will be discussed in detail. The first flexible line 31 includes a first end 75, an opposite second end 76, and a flexible conduit 78 as shown in FIG. 2. The first end 75 of the first flexible line 31 is coupled to the first output port 211 of the first modular gas manifold 21. The flexible conduit 78 is then routed through the gap 26 to the first gas outlet 41 where there second end 76 is coupled to the first gas outlet 41. The flexible line 31 permits technicians and maintenance personal the ability to route flexible line 31 in an initial routing path and then change flexible line 31 to different routing path.

The head wall 14 includes a modular frame 55 and a plurality of panels 500-516 that cooperate to define an outer surface 16 as shown in FIGS. 1 and 2. The modular frame 55 includes a plurality of columns 581-585 secured together by removable fasteners. The columns 581-585 are spaced apart from one another by a distance form the gap 26 therebetween. The panels 501-516 are coupled to the columns 581-585 to form the outer surface 16 by additional removable fasteners that are position in the gap 26 and recessed from the surface 16 of the panels 500-516.

As shown in FIGS. 1 and 2, the first gas outlet 41 is coupled to the second panel 502. A series of electrical power outlets 58 are coupled to the third panel 503 and coupled electrically to an electrical junction box 60 arranged in gap 26 as shown in FIG. 2. The third panel 503 is formed to include five apertures 65, 66, 67, 68, 69 arranged to open into the gap 26. As an example, first gas outlet 41 is arranged to extend through aperture 65. When one of the apertures is not in use, a knock-out plate 70 is coupled to the outer surface 16 and arranged to cover the unused aperture. As shown in FIGS. 1 and 2, apertures 66 and 69 are not used, and as a result, they are shown in phantom.

The gas distribution system 20 further includes a second source 82 of a second gas, a second supply line 62, and a second supply port 72. The second source 82 of the second gas is positioned to lie outside of the head wall 14. The second supply line 62 is coupled to the second source 82 to provide the second gas to the patient's room. The second supply line 62 terminates in the gap 26 at a second supply port 72 as shown in FIG. 2.

The gas distribution system 20 also includes a third source 83 of a third gas, a third supply line 63, and a third supply port 73. The third source 83 of the third gas is positioned to lie outside of the head wall 14. The third supply line 63 is coupled to the third source 83 to provide the third gas to the patient's room. The third supply line 63 terminates in the gap 26 at a third supply port 73 as shown in FIG. 2.

As an example, the first gas is compressed air, the second gas is oxygen gas, and the third gas is a vacuum. An illustrative first source 81 of compressed air may be an air compressor or a compressed-air storage tank. An illustrative second source 82 of oxygen may be pressurized oxygen tanks. An illustrative third source 83 of vacuum may be vacuum pump. The sources 81, 82, 83 may be located in a centralized area in the hospital away from the patient rooms so as to maximize ease of maintenance and minimize disruptions to the patients from noisy compressors and pumps. Also, nitrogen gas may be used in addition to the three gases listed as needed by the hospital.

The first gas outlet 41 is illustratively an outlet for compressed air which includes a pressure regulator that may be set by the caregiver at the appropriate pressure needed for medical equipment and accessories. However, the gas outlet may also be configured for use with the vacuum source 83 and include a vacuum canister and a regulator. Still yet, the gas outlet may be configured for use as an oxygen outlet which may include a flow regulator so that an appropriate amount of oxygen is supplied to the patient.

The gas delivery assembly 10 further includes a second modular gas manifold 22 and a second flexible line 32 as shown in FIG. 2. The second modular gas manifold 22 includes a body 28 that is formed to include a space 30, a supply connector 50, and a plurality of output ports 221, 222. The supply connector 50 is arranged to interconnect the second supply port 72 and the space 30 of the second modular gas manifold 22. The output ports 221, 222 are coupled to the body 28 in fluid communication with the space 30. The second flexible line 32 is coupled to the first output port 221 and to a second gas outlet 42 as shown in FIG. 2. The second gas outlet 42 is spaced-apart from first gas outlet 41.

The gas delivery assembly 10 further includes a third modular gas manifold 23 and a third flexible line 33 as shown in FIG. 2. The third modular gas manifold 23 includes a body 28 that is formed to include a space 30, a supply connector 50, and a plurality of output ports 231, 232. The supply connector 50 is arranged to interconnect the third supply port 73 and the space 30 of the third modular gas manifold 23. The output ports 231, 232 are coupled to the body 28 in fluid communication with the space 30. The third flexible line 33 is coupled to the first output port 231 and to a third gas outlet 43 as shown in FIG. 2. The third gas outlet 43 is spaced-apart from and below the first and second gas outlets 41, 42.

Figure 3:
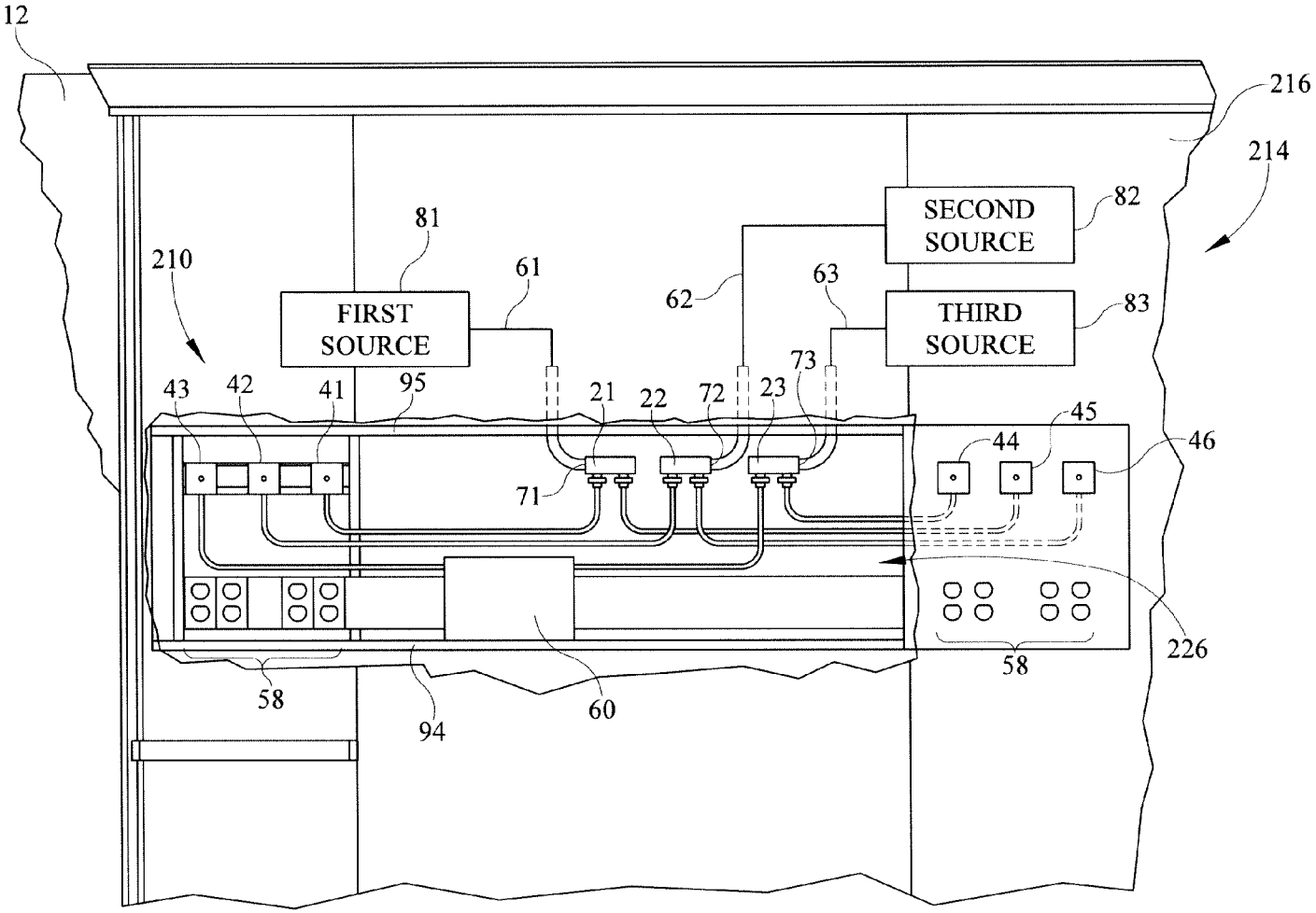
FIG. 3 is a partial perspective view of another embodiment of a head wall with portions broken away to reveal another embodiment of a gas delivery assembly.

According to the present disclosure, another embodiment of a gas delivery assembly 210 for use in a patient room in a healthcare facility is provided in a head wall 214 of patient room as suggested in FIG. 3. The head wall 214 is configured to route electricity, compressed air, oxygen, and vacuum from the wall 12 to a front surface 216 of the head wall 214 for use by a caregiver. The gas delivery assembly 210 comprises the centralized gas distribution system 20, the modular gas manifolds 21, 23, and 23, the flexible lines 31, 32, and 33, and the gas outlets 41, 42, 43 as shown in FIG. 3. The gas delivery assembly 210 is different than the gas delivery assembly 10 in that the gas delivery assembly 210 is arranged to lie in a horizontal gap 226 formed in the head wall 214 between two cross bars 94, 95 as shown in FIGS. 3 and 4.

As illustrated in FIG. 3, the gas delivery assembly 210 further includes a fourth, fifth, and sixth flexible lines 34, 35, 36 and fourth, fifth, and sixth gas outlets 44, 45, and 46. Fourth flexible line 34 is arranged to interconnect the second output port 212 of first modular gas manifold 21 and the fifth gas outlet 45 which is spaced apart from first gas outlet 41 on the opposite side of the head wall 214. Fifth flexible line 35 is arranged to interconnect the second outlet port 222 of the second modular gas manifold 22 and the sixth gas outlet 46 which is spaced apart from second gas outlet 42. Sixth flexible line 36 is arranged to interconnect the second output port 232 of the third modular gas manifold 23 and the fourth gas outlet 44 which is spaced apart from the third gas outlet 43.

Figure 4:
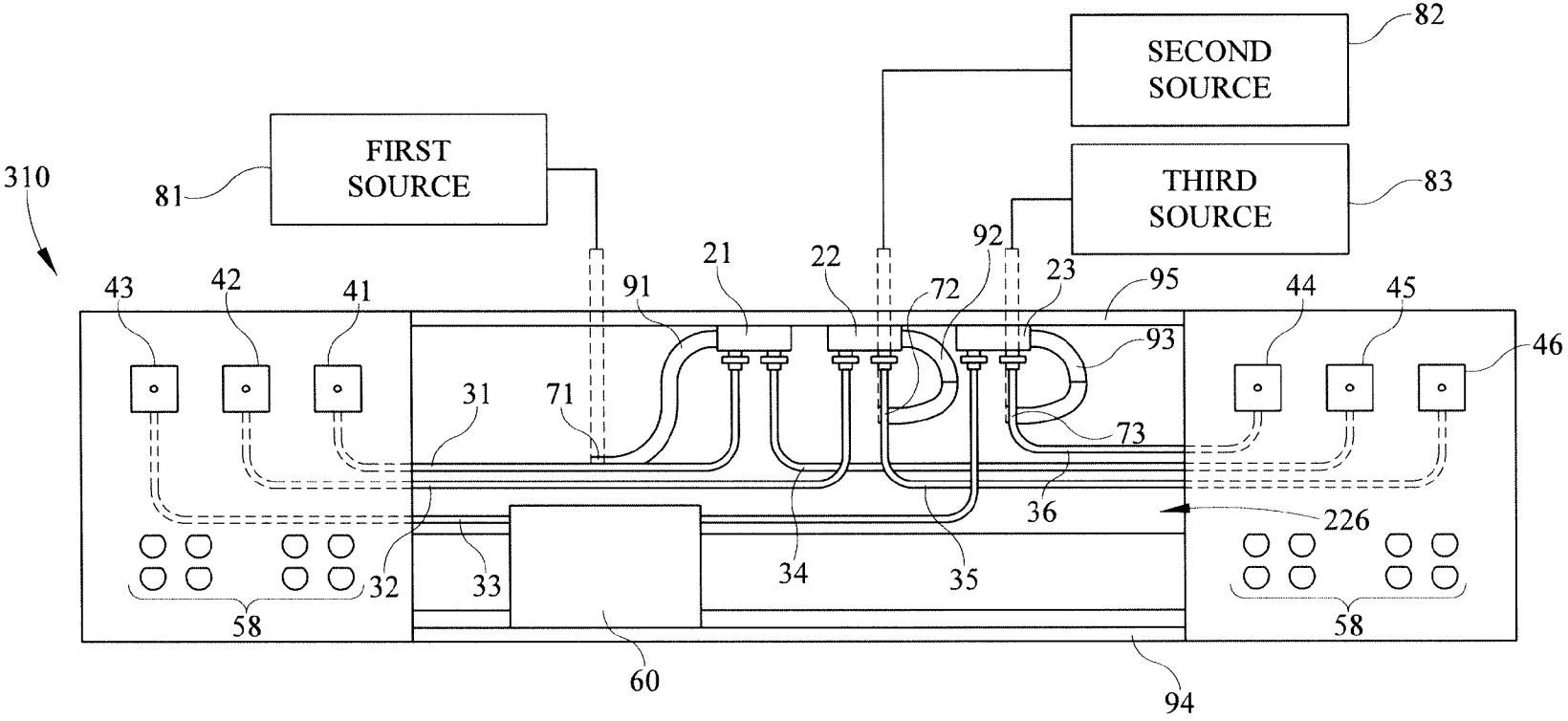
FIG. 4 is an elevation view and diagrammatic view of another embodiment of a gas delivery assembly.

According to the present disclosure, still yet another embodiment of a gas delivery assembly 310 is shown in FIG. 4. The gas delivery assembly 310 is different from the gas delivery assembly 210 in that the modular gas manifolds 21, 22, 23 are coupled to a gas distribution system 320 using a set of flexible supply hoses 91, 92, and 93 rather than coupling directly the modular gas manifolds 21, 22, 23 to their associated supply ports 71, 72, 73 included in the gas distribution systems 20 and 220.

As shown in FIGS. 3 and 4, first, second, and third modular gas manifolds 21, 22, 23 are two-port manifolds which means that each modular gas manifold 21, 22, 23 includes two outlet ports. As a result of the configuring the modular gas manifolds 21, 22, and 23 as shown in FIGS. 3 and 4, all of the outlet ports included in each modular gas manifold 21, 22, 23 are full and no further expansion is possible as configured in FIGS. 3 and 4.

Figure 5:
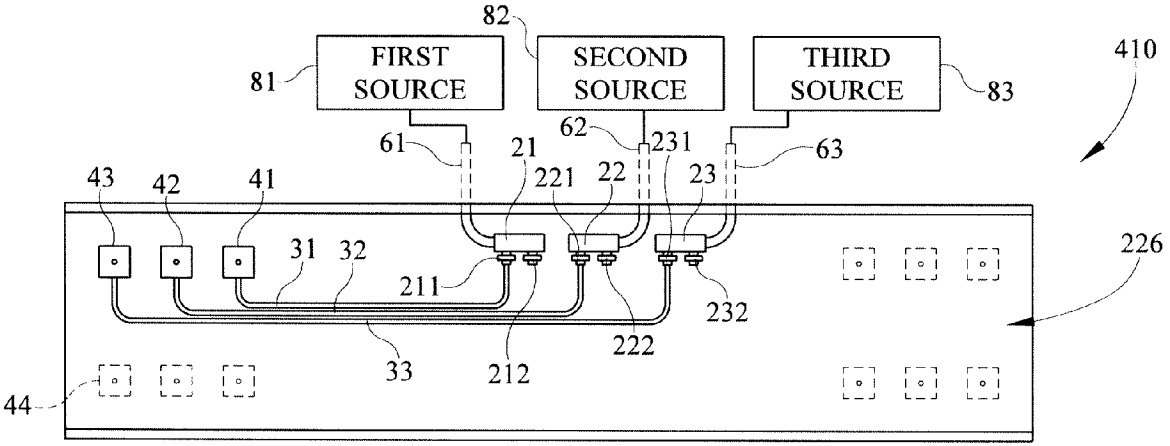
FIGS. 5 and 6 are a series of views showing how an exemplary gas delivery assembly may be expanded and modified.
Figure 6:
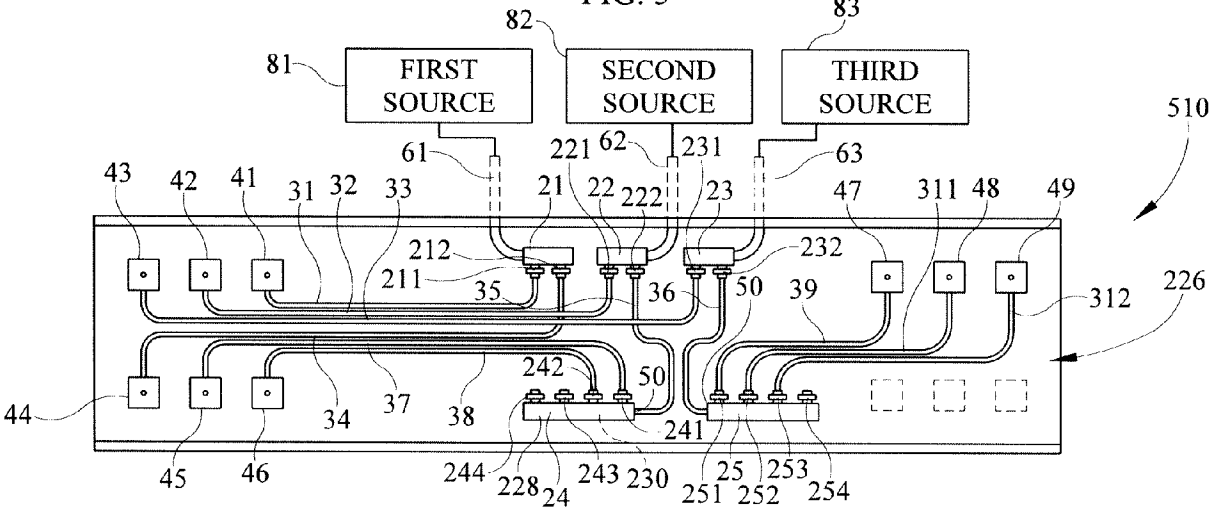

Another example of a gas delivery assembly 410 is shown in an initial configuration in FIG. 5 and a changed gas delivery assembly 510 is shown in FIG. 6. The initial configuration of gas delivery assembly 410 shown in FIG. 5 provides one gas outlet 41, 42, 43 for each modular gas manifold 21, 22, 23. This arrangement permits a user in the field to add an additional gas outlet 44, 45, 46 for each modular gas manifold 21, 22, 23 thus filling each of the available outlet ports on each modular gas manifold 21, 22, 23. The changed gas delivery assembly 410 has been achieved by adding a fourth and a fifth manifold 24, 25 to the gap 226 as shown in FIG. 6. As an example, the fourth and fifth modular gas manifolds 24, 25 are substantially similar to the modular gas manifolds 21, 22, and 23 except that the fourth and fifth manifolds each contain four outlet ports.

As illustrated in FIG. 6, the gas delivery assembly 410 of FIG. 5 has been altered by adding fourth flexible line 34 which interconnects the second output port 212 of the first modular gas manifold 21 and a fourth gas outlet 44 which is positioned in spaced-apart relation below the first gas outlet 41. The gas delivery assembly 410 is further altered by adding a fifth flexible line 35 which interconnects the second outlet port 222 of the second modular gas manifold 22 and the supply connector 50 of the fourth modular gas manifold 24. This arrangement allows the second gas to flow from the second modular gas manifold 22 into a space 230 formed in a body 228 of the fourth modular gas manifold 24. As a result of fourth modular gas manifold 24 including four output ports 241, 242, 243, and 244, four additional gas outlets may be connected and used. In exemplary use, two additional flexible lines 37, 38 are added to provide fifth and sixth gas outlets 45, 46 with the second gas.

Similarly, a sixth flexible line 36 is also added to the gas delivery assembly 310 which interconnects the second output port 232 of the third modular gas manifold 23 and the supply connector 50 of the fifth manifold 25. This arrangement allows third gas to flow from the third modular gas manifold 23 into the space 230 formed in the body 228 of the fifth manifold so that four output ports 251, 252, 253, 254 included in the fifth manifold may be supplied with the third gas. As an example, three additional flexible lines 39, 311, and 312 are added and used to interconnect seventh, eighth, and ninth gas outlets 47, 48, and 49 with the associated output ports 251, 252, and 253 included in the fifth manifold 25 as shown in FIG. 6.

The gas delivery assembly 410 is now arranged so that the first and fourth gas outlets 41, 44 are supplied with the first gas. Similarly, the second, fifth, and sixth gas outlets 42, 45, 46 are supplied by the second gas. Finally, the third, seventh, eighth, and ninth gas outlets 43, 47, 48, and 49 are supplied by the third gas. Use of the flexible lines 31, 32, 33, 34, 35, 36, 37, 38, 39, 311, and 312 and modular gas manifold 21, 22, 23, 24, and 25 allow positioning of the manifolds and routing of the supply lines to be accomplished while working in a confined gap 226 with other existing components.

Figure 7:
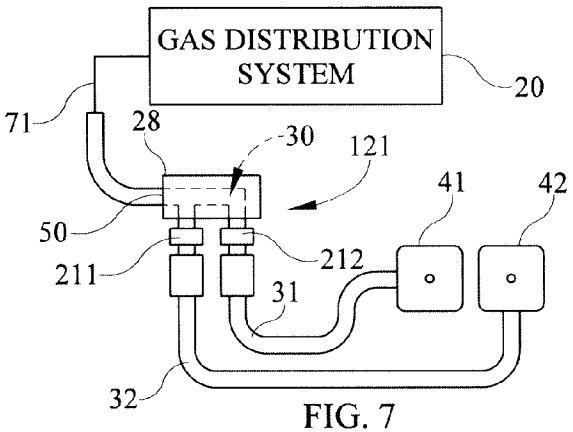
FIG. 7 is an elevation view of a two-port gas manifold in use.
Figure 9:
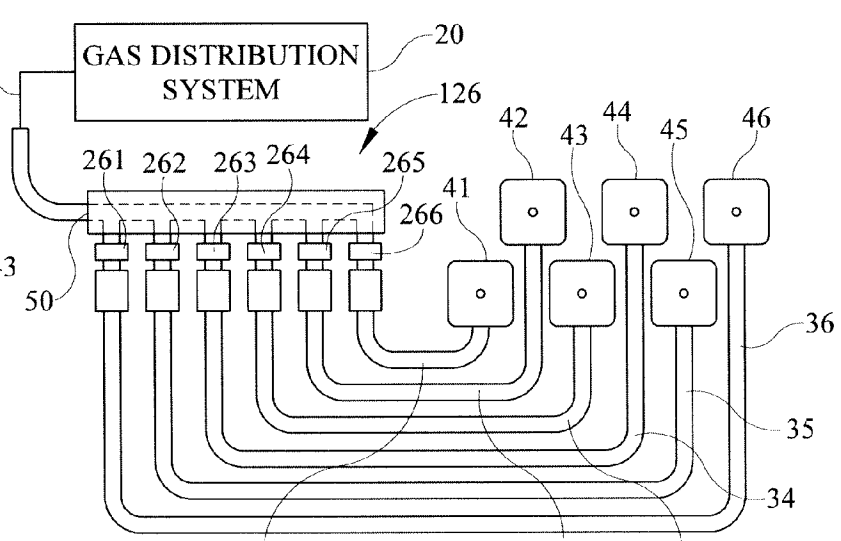
FIG. 9 is an elevation view of a six-port gas manifold in use.
Figure 8:
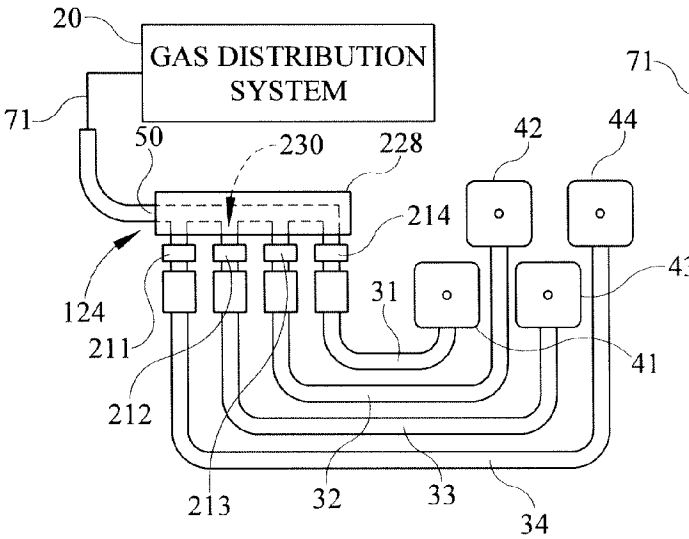
FIG. 8 is an elevation view of a four-port gas manifold in use.

An example of first, second, and third modular gas manifolds 21, 22, 23 is shown as a two outlet-port manifold 121 in FIG. 7. The two outlet-port manifold 121 includes two output ports 211 and 222 which are shown illustratively coupled via flexible lines 31, 32 to first and second gas outlets 41, 42, and 43. An example of fourth and fifth modular gas manifolds 24 and 25 is shown as a four outlet-port manifold 124 in FIG. 8. The four outlet-port manifold 124 includes four output ports 241, 242, 243, and 244 which are shown illustratively coupled via flexible lines 31, 32, 33, and 34 to first, second, third, and fourth gas outlets 41, 42, 43, and 44. A larger six outlet-port manifold 126 is shown in FIG. 8. The eight outlet-port manifold 126 includes six outlet ports 261, 262, 263, 264, 265, and 266 which are coupled via six flexible lines 31, 32, 33, 34, 35, and 36 to first, second, third, fourth, fifth, and sixth 41, 42, 43, 44, 45, 46. Each manifold, whether a two-output manifold, a four outlet-port manifold, a six outlet-port manifold or larger each includes a number of D.I.S.S. check valves that equal the number of outlet ports included in the manifold.

Figure 10:
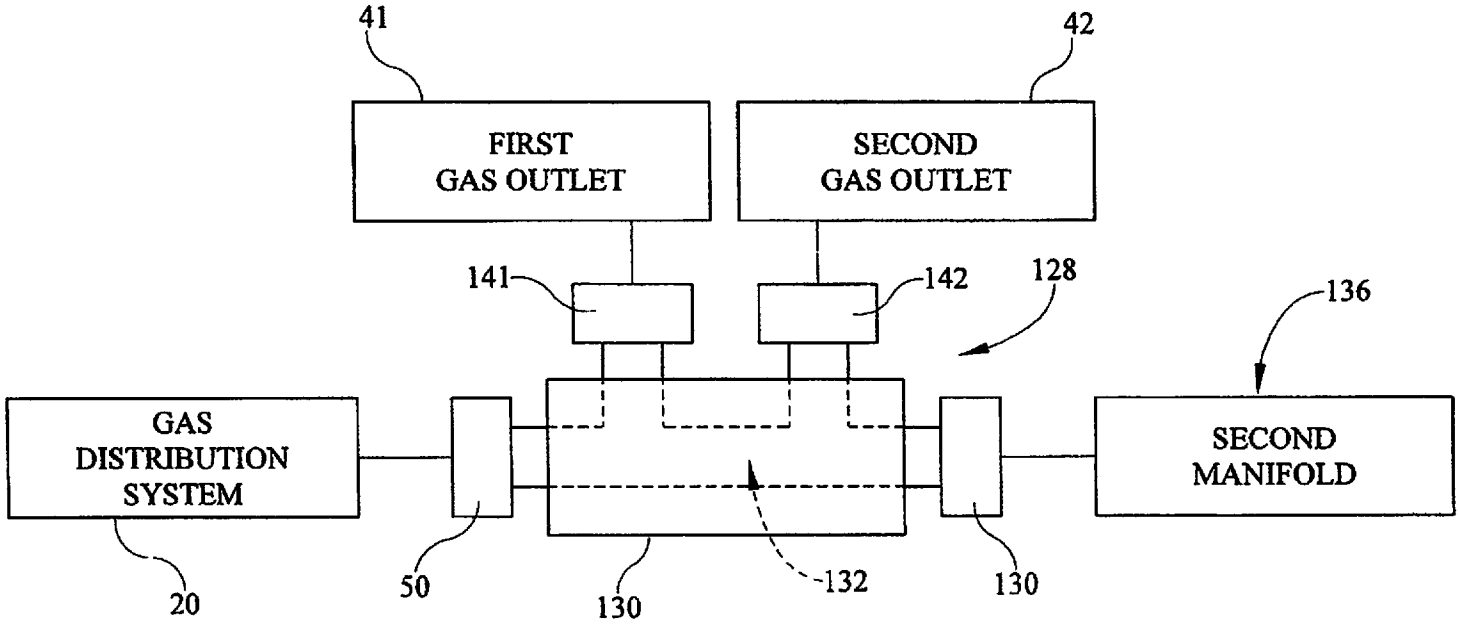
FIG. 10 illustrates another modular gas manifold.

Another exemplary modular gas manifold 128 is shown in FIG. 10. The modular gas manifold 128 includes a body 130 formed to include a space 132, the supply connector 50, a plurality of output ports 141, 142, and an expansion output port 134 as shown in FIG. 10. The supply connector 50 interconnects the body 130 to the supply port included in the gas distribution system 20 so that gas is provided to the space 132. The plurality of output ports 141, 142 are coupled to the space 132 formed in the body 130 to provide the gas when a flexible line is coupled to one of the output ports 211, 212. The expansion output port 134 is used to allow expansion of modular gas manifold 128 by coupling a second modular gas manifold 136 to the expansion output port 134 of the modular gas manifold 128 as suggested in FIG. 10. When the expansion output port 134 is not in use, a port plug is coupled to the expansion output port 134 to block the flow of the gas from the space 132 through the expansion output port 134.

As an example, the first modular gas manifold 128 may be coupled to gas distribution system 20 via supply connector 50. First and second outlet ports 141, 142 are coupled to the first and second gas outlets 41, 42 using all the available outlet capacity of the first modular gas manifold 128. Additional gas outlets may be supplied by adding the second modular gas manifold 136 to the expansion output port 134 of the first modular gas manifold 128. The supply connector 50 of the second modular gas manifold 136 may be coupled directly the expansion output port 134 of the first modular gas manifold or coupled by an intermediary flexible hose.

As an example, the supply lines included in the gas distribution system may be metal. The supply ports used to terminate the supply lines may be metal and may be coupled to the supply lines by brazing the supply port onto the supply line. Another alternative for coupling the supply port to the supply line may be using a threaded supply line and a threaded supply port coupled to the supply line. Still yet another alternative for coupling the supply port to the supply line is using quick-disconnect hose couplings. As an example, the supply may be fitted with a female socket that is used as the supply port.

The supply port may be coupled to the supply connector 50 of the modular gas manifold using any of the coupling techniques previously discovered. In addition, the outlet port of the modular gas manifold may be coupled to the flexible line using any of the coupling techniques previously discussed.

In some headwalls, gas types may be grouped together for convenience. As an example, the compressed air gas outlets may be grouped together on a patient-left side of the head wall and the oxygen outlets may be group together on a patient-right side of the headwall. The modular gas manifolds may be used to minimize the length and complexity of flexible hoses used to connect the gas outlets. The modular gas manifold associated with the compressed air may be moved from a center portion of the headwall to the patient-left side of the headwall and then short flexible lines may be used to couple the modular gas manifold to the gas outlets. As a result, the supply line associated with compressed air is routed to the center of the headwall and a flexible line is used to couple the supply port of the supply line to the modular gas manifold. Now, only one flexible line is routed from the center portion of the headwall to the patient-left portion and several small simple flexible lines are used to couple the modular gas manifold to the gas outlets.

Although certain illustrative embodiments have been described in detail above, variations and modifications exist within the scope and spirit of this disclosure as described and as defined in the following claims.

The invention claimed is:

1. A gas delivery assembly for a patient room in a healthcare facility including a wall, the gas delivery system comprising:

a centralized gas distribution system in the healthcare facility, the centralized gas distribution system including a source of a gas, a supply line coupled to the source, and a supply port coupled to the supply line, a first modular gas manifold including a body formed to include a space, a supply connector interconnecting the body and the supply port to provide fluid communication with the space, and a pair of output ports coupled to the body, a second modular gas manifold including a body formed to include a space, a supply connector interconnecting the body of the second modular gas manifold and one of the output ports included in the first modular gas manifold to provide fluid communication with the space of the first modular gas manifold and the space of the second modular gas manifold, and a pair of output ports coupled to the body of the second modular gas manifold, a pair of gas outlets coupled to the wall and coupled to the outlet ports of the second modular gas manifold in fluid communication with the space formed in the second modular gas manifold, and wherein the wall includes at least one of (a) a modular frame structure including first and second columns extending upwardly from a floor, the first and second columns spaced apart from one another to define a vertical gap therebetween, and the first and second modular gas manifolds lie in the vertical gap between the first and second columns or (b) a modular frame structure including first and second columns spaced-apart laterally from one another, a first cross bar interconnecting the first and second columns, and a second cross bar spaced apart below the first cross bar, the second cross bar interconnects the first and second columns and cooperates with the first cross bar to define a horizontal gap therebetween, and the first and second modular gas manifolds lie in the horizontal gap between the first and second cross bars.

2. The gas delivery assembly of claim 1, wherein the wall further includes a panel coupled to the modular frame structure to form a surface, the panel is formed to include a plurality of apertures opening into at least one of the vertical and horizontal gaps and the pair of gas outlets lie in two of the plurality of apertures.

3. The gas delivery assembly of claim 2, wherein the wall further includes a knock-out panel coupled to the panel to cover one of the plurality of apertures not being filled with one of the pair of gas outlets.

4. A gas delivery assembly for a patient room in a healthcare facility including a wall, the gas delivery system comprising:

a centralized gas distribution system in the healthcare facility, the centralized gas distribution system including a source of a first gas, a first supply line coupled to the source of the first gas, and a first supply port coupled to the first supply line, a first modular gas manifold including a body formed to include a space, a supply connector coupled to the body and to the first supply port to admit the first gas from the source into the space, and a plurality of output ports coupled to the body in fluid communication with the space, a first flexible line coupled to one of the plurality of output ports, a first gas outlet coupled to the wall and coupled to the first flexible line to cause the first gas to be supplied to a caregiver upon demand, wherein the wall includes a modular frame structure including a plurality of columns secured together by removable fasteners and spaced apart from one another by a distance to form a gap therebetween, a plurality of panels coupled to the modular frame structure to form a surface, the panels being secured to the modular frame structure by removable fasteners, and the removable fasteners securing the panels to the modular frame structure are positioned in the gap and recessed from the surface of the panels, and the first gas outlet is coupled to at least one of the panels, and a second flexible line coupled to another of the plurality of output ports included in the first modular gas manifold and a second modular gas manifold including a body formed to include a space, a supply connector coupled to the body of the second modular gas manifold and to the second flexible line and configured to admit gas from the second flexible line into the space formed in the body of the second modular gas manifold, and a second plurality of output ports coupled to the body of the second modular gas manifold in fluid communication with the space formed in the body of the second modular gas manifold.

5. The gas delivery assembly of claim 4, further comprising a third flexible line coupled to one of the plurality of output ports included in the second modular gas manifold and coupled to a second gas outlet coupled to the wall.

6. The gas delivery assembly of claim 1, wherein the first gas is compressed air.

7. The gas delivery assembly of claim 1, wherein the first gas is oxygen.

8. The gas delivery assembly of claim 1, wherein the first gas is a vacuum.

9. The gas delivery assembly of claim 4, wherein the first modular gas manifold and the first supply line lie in the gap behind the panels.

10. The gas delivery assembly of claim 9, wherein the at least one of the panels is formed to include a first and second aperture opening into the gap, the first aperture is configured to receive the first gas outlet therein, and the second aperture is covered by a knock-out plate coupled to the at least one panel that includes the first and second aperture opening.

11. The gas delivery assembly of claim 4, wherein the centralized gas distribution system further includes a source of a second gas, a second supply line coupled to the source of the second gas, and a second supply port coupled to the second supply line.

12. The gas delivery assembly of claim 11, wherein the second modular gas manifold is spaced-apart from the first modular gas manifold, the supply connector of the second modular gas manifold coupled to the body of the second modular gas manifold and to the second supply line to admit the second gas from the source of the second gas into the space of the second modular gas manifold.

13. The gas delivery assembly of claim 12, further comprising a second gas outlet coupled to the wall in spaced-apart relation to the first gas outlet and the second flexible line coupled to one of the plurality of output ports included in the second modular gas manifold and to the second gas outlet to provide the second gas to the caregiver upon demand.

14. The gas delivery assembly of claim 13, further comprising a third flexible line coupled to another of the plurality of output ports included in the first modular gas manifold and a third modular gas manifold including a body formed to include a space, a supply connector coupled to the body of the third modular gas manifold and to the third flexible line to admit the first gas from the third flexible line into the space formed in the body of the third modular gas manifold, and a plurality of output ports coupled to the body of the third modular gas manifold in fluid communication with the space formed in the body of the third modular gas manifold.

* * * * *